United States Patent [19]

Balon et al.

[11] 4,173,182

[45] Nov. 6, 1979

[54] STAMPING MECHANISM FOR ROLLED GOODS WITH ARTICLE ALIGNMENT STRUCTURE

[75] Inventors: Johannes Balon, Dortmund; Manfred Oldendorf, Iserlohn, both of Fed. Rep. of Germany

[73] Assignee: Hoesch Werke Aktiengesellschaft, Dortmund, Fed. Rep. of Germany

[21] Appl. No.: 842,782

[22] Filed: Oct. 17, 1977

[30] Foreign Application Priority Data

Oct. 15, 1976 [DE] Fed. Rep. of Germany ..... 2646560

[51] Int. Cl.[2] ..... B41F 17/00

[52] U.S. Cl. ..... 101/4; 101/44

[58] Field of Search ..... 101/4, 44, 35, DIG. 3; 118/2, 8; 72/421, 428, 14, 16; 198/395

[56] References Cited

U.S. PATENT DOCUMENTS

| | | | |
|---|---|---|---|
| 1,838,153 | 12/1931 | Phelps | 101/44 X |
| 3,177,802 | 4/1965 | Stevens | 101/44 |
| 3,638,712 | 2/1972 | Rudor | 101/4 X |
| 3,838,292 | 9/1974 | Sullivan | 198/395 X |
| 3,943,846 | 3/1976 | Geisow et al. | 101/4 |
| 3,967,724 | 7/1976 | Allen et al. | 198/395 |

FOREIGN PATENT DOCUMENTS

| | | | |
|---|---|---|---|
| 1428385 | 3/1976 | United Kingdom | 101/4 |

*Primary Examiner*—Clifford D. Crowder
*Attorney, Agent, or Firm*—Becker & Becker, Inc.

[57] ABSTRACT

A stamping device especially for heavy products such as rolled goods which, when being transported, are stamped on a roller train equipped with a guiding device. The guiding device comprises a feeler device and an aligning device connected to the feeler device, a stamping head being connected to the aligning device.

6 Claims, 1 Drawing Figure

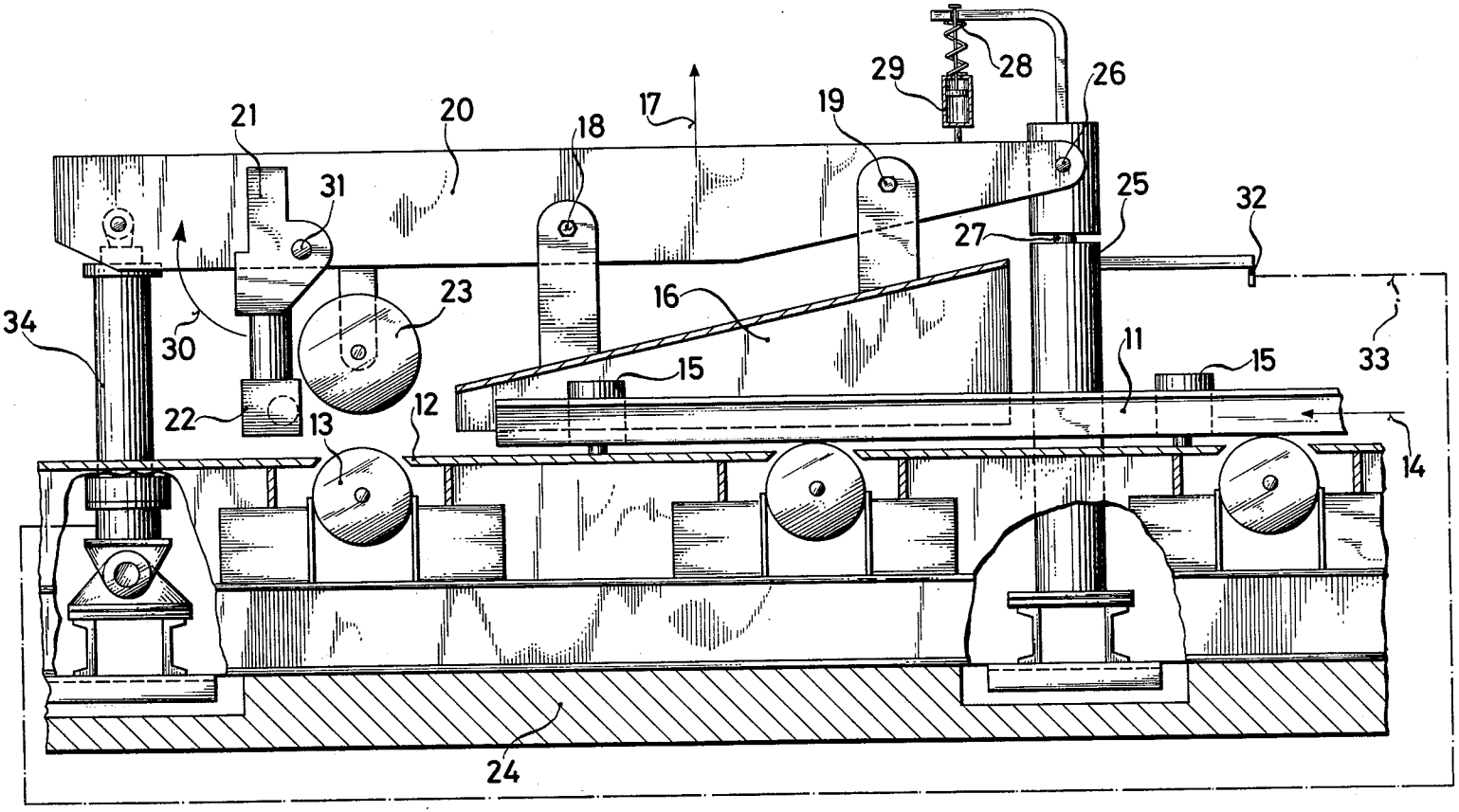
33
14
32
15
25
11
26
28
27
29
19
16
15
17
18
24
20
23
12
31
13
21
30
22
34

STAMPING MECHANISM FOR ROLLED GOODS WITH ARTICLE ALIGNMENT STRUCTURE

The present invention relates to an automatic stamping or punching device in particular for heavy products such as rolled material which at the end face during the transporting movement is stamped or punched on a roller train provided with guiding devices.

With stamping or punching devices of this type relatively small stamping or punching areas, guiding devices are necessary which bring about an aligning of the punching or stamping head with regard to the end face of the rolling material prior to the stamping or punching operation.

An automatic stamping device with guiding means is described for instance in German Offenlegungsschrift No. 23 20 796. The guiding devices consist in this instance of conical rollers of the roller train or of rollers arranged at an incline which bring about that the rolled material moves to one side of the roller train against a fixed abutment or against a roll with the vertical axis. During the further movement on the roller train, the rolled material is then guided by the abutment or by the roller. This relatively large guiding device described in the above mentioned German Offenlegungsschrift suffices with products having a very large end face as for instance slabs. In this connection, it is immaterial if the marking is not always precisely in the center of the end face of the slab because also with a seat which is non-symmetrically arranged with regard to the center, the distance to the confining edges furnishes still enough space for the marking. This sufficient space is not available when the rolled goods are profiles. For instance with an I-beam, the marking must be precisely symmetrical with regard to the center of a flange. The situation is even more difficult when for instance an L-beam is to be marked. Such beam becomes curved after the rolling because due to its surface it cools off non-uniformly. A curved beam fully engages for instance the above described guiding devices with its center portion where it is guided, whereas its end face is not guided. This end face will when the curvature of the beam is in upward direction, be offset up to 50 cm above the roller train plane. A similar variation of the position of the end face also occurs laterally on the roller train. When the end faces are greatly offset to each other, the stamping head does not any longer hit the end face, and an automatic stamping is not possible.

It is, therefore, an object of the present invention to provide a stamping device which will make it possible to stamp the end face of irregularly distorted profiles while the stamping head and the end face are aligned in a very precise manner.

These and other objects and advantages of the invention will appear more clearly from the following specification in connection with the accompanying drawing, which diagrammatically illustrates one embodiment of a stamping device according to the present invention.

The stamping device according to the present invention, especially for heavy products such as rolled material which is stamped at its end face during the transporting movement of a roller train provided with a guiding device, is characterized primarily in that it comprises a sensing device or feeler arrangement and an aligning device operatively connected therewith, to which the stamping head is fastened.

According to a particularly simple embodiment of the invention, the aligning device comprises a long aligning beam which longitudinally extends in the direction of the roller plane and which at the end which is first reached by the rolled material is rotatably journalled in a framework connected to the foundation, and to which further in the direction to the other end, the stamping machine and the sensing device are directly or through a spacer so connected that the movement of the sensing device is conveyed to the carrier for the aligning means, through the movement of which the stamping head connected thereto is brought into the proper position. The sensing or feeling device is moved by the rolled goods in such a way that for the aligning movement of the stamping head no special drive is required. The simple aligning beam carries out three functions:

(a) it takes care of the movable mounting of the sensing device and stamping head, and simultaneously serves as transmission for transmitting the movement from the sensing device to the stamping head;

(b) the sensing device is particularly advantageously designed if it consists of a funnel-shaped hood placed over a portion of the roller train and provided with a large inlet opening for the rolled material at one end of the hood and furthermore provided with a small outlet opening at the other end for the rolled material.

The hood is foldable upwardly and downwardly at the small outlet opening, and is movable laterally. For purposes of reducing the friction and the wear of the hood, it is advantageous when the outlet opening is greater than the cross section of the rolled material goods. For precisely, and in a play-free manner, aligning the sensing device with regard to the rolled material, it is therefore necessary that one or more rolls are located between the sensing device and the stamping head which through their mounting arrangement are connected to the aligning carrier and by a force are pressed against the surface of the rolled goods. As a rule, the roll is pressed against the rolled material by its own weight and by the weight of the aligning carrier. The pressing on force may additionally be reinforced by auxiliary means as for instance a spring. The additional force of the spring is able also via a cushioning cylinder to act upon the aligning carrier. The spring as well as the cushioning cylinder has the advantage that the aligning carrier in response to a suddenly occurring upward movement will never in view of the movement energy stored therein, be shifted so high that the roll is lifted off from the rolled material.

It is advantageous when the pressing-on force of the roll is high because, particularly with thin resilient profiles, also an aligning or straightening out of the profile is effected without the movement of the aligning carrier because the pressing-on force presses the profile in a resilient manner into the proper position. This last mentioned aligning operation operating in part in conformity with the principle of heretofore known guiding devices, is possible by very thin resilient profiles and by very small aligning strokes. With greater aligning strokes, also a movement of the aligning beam will always occur.

The aligning operation will be especially precise when the roll has a profile corresponding to the profile of the material to be rolled.

In order to be able by the same stamping device also to stamp different profiles, the hood and the roll are easily exchangeably connected to the aligning carrier.

In order to avoid damage to the stamping device, a second feeling or sensing device is provided ahead of said stamping device. This second feeling or sensing device examines the material being transported to true measurement and correct position, and if predetermined limit values are exceeded, turns on a drive which folds upwardly the aligning carrier with all parts mounted thereon so that that part of the roller train which is located therebelow can be passed over by the rolled goods. In view of its fast effect, as drive, particularly a compressed air cylinder, is suitable. The feeling device may operate purely mechanically or may consist of a profile which is movably arranged above the roller train, but it may also in a manner known per se be equipped with light barriers.

Referring now to the drawing in detail, the profile 11 to be stamped is on the roller train 12 with the rolls 13 transported to the stamping device in conformity with the transporting direction 14. A coarse aligning of the profile 11 is effected already prior to the profile to be stamped entering the stamping device because the rolls 13 are arranged on a slight slant with regard to the axes of the roller train. In view of this inclined position, the profile 11 moves against the vertical guiding rollers 15 and is guided by the same. If the profile 11 is bent upwardly, the upper edge of the end face of the profile abuts against the inclined downwardly extending wall of the feeling device 16. This feeling device 16 is during the further advance of the profile 11 on the roller train 12 pressed upwardly in the direction 17. Inasmuch as the feeling device 16 is by means of screws 18 and 19 connected to the aligning carrier or beam 20, also this carrier or beam moves in the direction 17. The stamping machine 21 with the stamping head 22 is likewise connected to the aligning beam 20 so that also the stamping head 22 carries out the movement of the stamping beam 20 in the direction 17. In a corresponding manner, an aligning movement is produced by the roller 23 which is likewise connected to the aligning beam 20. The aligning beam 20 is journalled in the framework 25 which is connected to the foundation 24, said beam 20, being pivotable about a horizontal axis 26. The vertical axis 27 provides for the possibility of rotation of the aligning beam 20 in horizontal direction. By means of the spring 28, the force at which the roll 23 is pressed against the profile 11 can be reinforced so that a balancing will be realized. The effect of spring 28 may in a manner known per se be additionally influenced by the liquid filled shock absorber 29.

The endface of the profile 11 moves in view of the transporting movement of the roller train 12 against the stamping head 22 and during this abutment is stamped in a manner known per se. Subsequently, the stamping head, according to the direction 30, moves upwardly about the axle 31 so that the profile 11 can unimpededly move out of the stamping device.

When a profile 11 with such over measures arrives at the roller train 12 so that there exists the danger that it could jam in the feeling device 16 and could destroy the same, the profile 11 will then through the signalling light 33 put the compressed air cylinder 34 into operation which pivots the aligning beam 20 upwardly about a considerable distance in the direction 17 so that the profile 11 due to the stamping device can be transported further in unimpeded manner. After such oversized profile has passed the stamping device, its end releases a non-illustrated contact by means of which the cylinder 34 is returned to its starting position. This contact at the same time may also take care of the folding downward of the stamping head 22 into its starting position on the roller train 12 when after an effected stamping, the profile 11 has left the stamping device.

As will be evident from the above, the invention is applicable not only to roller mill products of steel but can also be used in connection with products of other materials and also with products which are produced in a different way, for instance in connection with drawn goods.

As will furthermore be evident from the above, the advantages realized by the invention consist in that also with greater variations in the position of the end face of the oncoming profiles, the latter can be stamped with a simple automatic stamping device which is safe in operation even for rough roller drives.

It is, of course, to be understood that the present invention is, by no means, limited to the specific showing in the drawing, but also comprises any modifications within the scope of the appended claims.

What we claim is:

1. A stamping device, especially for stamping rolled goods, while the goods are being transported over a roller train, which includes: a feeler device for feeling the goods to be stamped, an aligning device having said feeler device connected thereto, and a stamping head fastened to said aligning device, said aligning device being operable by said feeler device to align the goods to be stamped with said stamping head, said aligning device including: a longitudinal aligning arm having its longitudinal extension in the direction in which the goods to be stamped are to be moved toward said stamping head, and supporting means supporting said aligning arm for pivoting in a vertical plane and in a horizontal plane, thereby permitting conveying movements of said feeler device onto said aligning device for aligning the goods to be stamped with said stamping head.

2. A stamping device according to claim 1, in which said feeler device includes a funnel-shaped hood forming a passage for the goods to be stamped and having a relatively large inlet opening for the goods to be stamped which is located at one end of said hood remote from said stamping head and also having a relatively small outlet opening for the goods to be stamped which is located relative close to said stamping head, said hood being movable upwardly and downwardly and laterally in conformity with the pivotal movement of said aligning arm.

3. A stamping device according to claim 2, which includes an additional feeler device located ahead of said relative large inlet opening of said hood and being operatively connected to said lifting device, said additional feeler device in response to the goods to be stamped exceeding predetermined dimensions of said hood being operable to actuate said lifting device for lifting said aligning arm together with said hood and said at least one roller and said stamping head to a safe level to protect said aligning arm and said hood and said stamping head from damage.

4. A stamping device according to claim 1, which includes at least one roller located between said feeler device and said stamping head and supported by said aligning arm, and means for biasing said at least one roller in downward direction.

5. A stamping device according to claim 4, in which said at least one roller has a profile corresponding to the profile of the goods to be stamped.

6. A stamping device according to claim 1, which includes spring means and shock absorber means associated with said aligning arm for continuously urging the latter to return to a predetermined rest position.

* * * * *